US011313019B2

(12) United States Patent
Tundal et al.

(10) Patent No.: US 11,313,019 B2
(45) Date of Patent: Apr. 26, 2022

(54) METHOD FOR PRODUCING A HEAT TREATABLE ALUMINUM ALLOY WITH IMPROVED MECHANICAL PROPERTIES

(71) Applicant: NORSK HYDRO ASA, Oslo (NO)

(72) Inventors: Ulf Tundal, Sunndalsøra (NO); Oddvin Reiso, Sunndalsøra (NO)

(73) Assignee: NORSK HYDRO ASA, Oslo (NO)

( * ) Notice: Subject to any disclaimer, the term of this patent is extended or adjusted under 35 U.S.C. 154(b) by 913 days.

(21) Appl. No.: 15/772,315

(22) PCT Filed: Dec. 21, 2016

(86) PCT No.: PCT/EP2016/082231
§ 371 (c)(1),
(2) Date: Apr. 30, 2018

(87) PCT Pub. No.: WO2017/108986
PCT Pub. Date: Jun. 29, 2017

(65) Prior Publication Data

US 2018/0282849 A1 Oct. 4, 2018

(30) Foreign Application Priority Data

Dec. 23, 2015 (NO) ..... 20151793
Feb. 12, 2016 (NO) ..... 20160252

(51) Int. Cl.
*C22F 1/05* (2006.01)
*C22C 21/08* (2006.01)
*B21C 23/00* (2006.01)

(52) U.S. Cl.
CPC ..... *C22F 1/05* (2013.01); *B21C 23/002* (2013.01); *C22C 21/08* (2013.01)

(58) Field of Classification Search
None
See application file for complete search history.

(56) References Cited

U.S. PATENT DOCUMENTS

2011/0278397 A1 11/2011 Bes et al.

FOREIGN PATENT DOCUMENTS

CN 104152758 11/2014
EP 2 883 973 6/2015
(Continued)

OTHER PUBLICATIONS

"AA 6061." Alloy Digest: Data on World Wide Metals and Alloys, Alloy Digest, 1990, pp. 1-2. (Year: 1990).*
(Continued)

*Primary Examiner* — Anthony M Liang
(74) *Attorney, Agent, or Firm* — Wenderoth, Lind & Ponack, L.L.P.

(57) ABSTRACT

Method for producing structural components from heat treatable aluminum alloys based on extruded material, in particular AA 6xxx series alloys, the components having improved crush properties and being particular applicable in crash zones of vehicles, such as longitudinals and crash boxes, the method including the following steps: a. casting a billet from said alloy by DC casting, b. homogenizing the cast billet, c. forming a profile from the billet by extrusion, preferably a hollow section d. optionally, separate solution heat treatment, e. quenching the profile down to room temperature after the forming step and the possible separate solutionising step, f. stretching the extruded or the separate solutionised profile to obtain at least 1.5% plastic deformation, g. artificially ageing the profile.

14 Claims, 15 Drawing Sheets

(56) References Cited

FOREIGN PATENT DOCUMENTS

Figure 1:
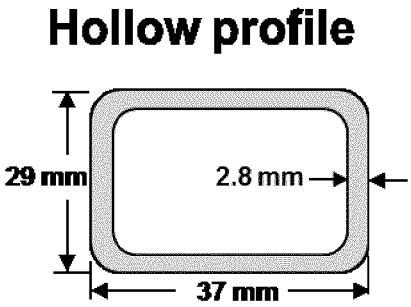
Figure 1:
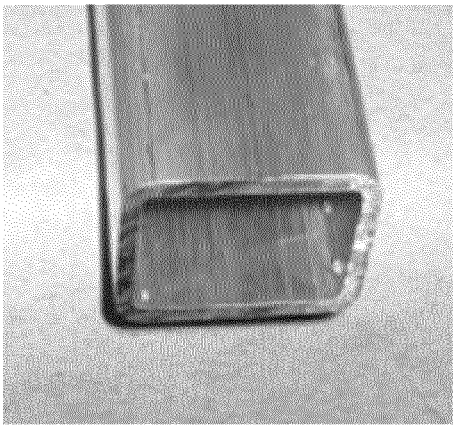

| | | |
|---|---|---|
| JP | 06-145918 | 5/1994 |
| JP | 08-53756 | 2/1996 |
| JP | 2000-239837 | 9/2000 |
| JP | 2001-140048 | 5/2001 |
| JP | 2001-335923 | 12/2001 |
| JP | 2003-049264 | 2/2003 |
| JP | 2005-023349 | 1/2005 |
| JP | 2005-023350 | 1/2005 |
| JP | 2007-247061 | 9/2007 |
| JP | 2007-254809 | 10/2007 |
| JP | 2014-201820 | 10/2014 |
| WO | 2011/061897 | 5/2011 |
| WO | 2012/144407 | 10/2012 |
| WO | 2015/086116 | 6/2015 |
| WO | 2016/034607 | 3/2016 |

OTHER PUBLICATIONS

Wang, Lawrence K., et al. Handbook of Advanced Industrial and Hazardous Wastes Treatment. Taylor & Francis, 2010, pp. 198-199. (Year: 2010).*

International Search Report dated Mar. 24, 2017 in International (PCT) Application No. PCT/EP2016/082231.

Kaufman "Properties of Aluminum Alloys, Fatigue Data and the Effects of Temperature, Product Form, and Processing", AMS International, 2008, p. 444.

Davis et al., "Aluminum and Aluminum Alloys", ASM Specialty Handbook, The Materials Information Society, pp. 314-315.

Hatch et al., "ALUMINIUM: Properties and Physical Metallurgy", American Society for Metals, 1984, pp. 189-191.

Court, et al., "Improved Performance in Al—Mg—Si (6xxx) extruded, structural alloys through microstructural control," The 4th International Conference on Aluminum Alloys, Their Physical and Mechanical Properties, vol. 1, pp. 395-402, Sep. 11-16, 1994, Georgia Institute of Technology, Atlanta, Georgia.†

"Standard Specification for Aluminum and Aluminum-Alloy Extruded Bars, Rods, Wire, Profiles, and Tubes," Designation B221-08, 2011 Annual Book of ASTM Standards, Section Two, vol. 02.02, pp. 215-228, 2011.†

"Aluminum Standards ad Data 2013", The Aluminum Association, pp. 1-7 through 1-9 and 11-2 through 11-5, Nov. 2013.†

"International Alloy Designation and Chemical Composition Limits for Wrought Aluminum and Wrought Aluminum Alloys," "Teal Sheets"; The Aluminum Association, pp. 1-10, Feb. 2009.†

Royset, "Al—Mg—Si Alloys with Improved Crush Properties", Proceedings of the Ninth International Aluminum Extrusion Technology Seminary, vol. II, ET Foundation, pp. 1-16, May 13-16, 2008, Orlando, FL.†

* cited by examiner
† cited by third party

Alloy 6110 – Short side of crushed samples

Un-stretched before ageing

Stretched 4% before ageing

Alloy 6061 – Recrystallized grain structure

Processed with no stretching before ageing

Processed with 2% stretching before ageing

| Mg | Si | Fe | Cu | Mn | Cr |
|---|---|---|---|---|---|
| 0.91 | 0.68 | 0.27 | 0.20 | 0.00 | 0.05 |

| | |
|---|---|
| Pre-Ageing - Stretching 4% - Storing 4h - Ageing 185/6h | PA-4% |
| Stretching 4% - Pre-Ageing - Storing 4h - Ageing 185/6h | 4%-PA |
| Stretching 4% - Storing 4h - Ageing 185/6h | 4% |
| Pre-Ageing - Storing 4h - Ageing 185/6h (no stretching) | PA-0% |
| Storing 4h - Ageing 185/6h (no stretching) | 0% |

| Alloy | Mg | Si | Fe | Mn | Cr | Cu | Ti |
|---|---|---|---|---|---|---|---|
| 6061 | 0.80 | 0.60 | 0.19 | 0.00 | 0.05 | 0.21 | 0.006 |

| Alloy | Mg | Si | Fe | Mn | Cr | Cu | Ti |
|---|---|---|---|---|---|---|---|
| 6005A | 0.63 | 0.54 | 0.21 | 0.13 | 0.00 | 0.17 | 0.07 |

Stretched
0.5%
Aged
3h/150+
4h/190

Stretched
2%
Aged
3h/150+
4h/190

Stretched
4%
Aged
3h/150+
4h/190

| Alloy | Mg | Si | Fe | Mn | Cr | Cu | Ti | Zn | Zr |
|---|---|---|---|---|---|---|---|---|---|
| 7030 | 1.12 | 0.08 | 0.10 | 0.00 | 0.00 | 0.25 | 0.01 | 5.06 | 0.00 |

0.5% stretched

4% stretched

Ageing Cycle: 100°C/7hrs + 140°C/15hrs

| Alloy | Mg | Si | Fe | Mn | Cr | Cu | Ti | Zn |
|---|---|---|---|---|---|---|---|---|
| **AA6451** | 0.64 | 0.81 | 0.18 | 0.23 | 0.02 | 0.01 | 0.02 | 0.01 |

AA 6061 - Recrystallized grain structure

AA 6110 Non-recrystallized grain structure

METHOD FOR PRODUCING A HEAT TREATABLE ALUMINUM ALLOY WITH IMPROVED MECHANICAL PROPERTIES

The present invention relates to a method for producing structural components, in particular from AA 6xxx series alloys, which are extruded or rolled and subjected to further processing to obtain improved mechanical properties.

The aluminum extrusion process normally begins by heating cast and homogenized billets or logs to a desired extrusion temperature (depending on the alloy, typically: 400-520° C.). The aluminum alloy is at such a temperature still solid but malleable. The heated aluminum billet is then transferred to a container in an extrusion press. Then, a stem with a dummy block that seals towards the container presses from behind, forces the aluminum alloy through the opening(s) of an extrusion die, in turn resulting in a long length of an aluminum extrusion, emerging from the other side of the die.

In a modern extrusion plant, the front of the profile is gripped by a puller that applies a certain force depending on the alloy and cross sectional area of the profile. Typically, two pullers with a flying saw operate simultaneously and cut the profile in the stop mark between two extruded lengths. The extrusions are subjected to cooling at the runout table by water quenching or air-cooling. Water quenched profiles are typically cooled down by a quench box or standing wave to room temperature at the runout table, whereas air-cooled profiles are typically further cooled down at the cooling table after being transferred from the runout table. If the metal flow in the extrusion die is well balanced and the cross section is not too asymmetrical the profile will remain reasonably straight if the profile is cooled by air. For a water-quenched profile, it can be more challenging to avoid that the profile bends during the cooling operation. However, with a quench box where the water flow can be adjusted independently from all sides and along the length of the quench box, most profiles can be quenched without too much bending and warping. In either case, the puller will help keeping the profile straight after extrusion and cooling.

The cooled extruded lengths are then normally stretched to obtain a plastic deformation in the range of 0.3-1.0%. The purpose of such stretching is to have stress-relief and straight profiles. The long extrusions are cut to desired lengths and are then usually subjected to a heat treatment step called artificial ageing. This ageing treatment, which significantly increases the strength, is typically done at a temperature between 140 and 220° C., depending on what properties the aluminum profiles are going to have.

From EP 2 883 973 A1 is known a process of the above kind for obtaining extruded products made from a 6xxx aluminum alloy where the extruded profiles after extrusion are quenched to room temperature and then optionally stretched between 0.5 and 5% to obtain stress relief and straight profiles, as is stated in the description of the patent application.

Document WO2016/034607 describes an aluminium alloy extruded product obtained by following steps: a) casting a billet from a 6xxx aluminium alloy comprising: Si: 0.3-1.5 wt. %; Fe: 0.1-0.3 wt. %; Mg: 0.3-1.5 wt. %; Cu<1.5 wt. %; Mn<1.0%; Zr<0.2 wt. %; Cr<0.4 wt. %; Zn<0.1 wt. %; Ti<0.2 wt. %, V<0.2 wt. %, the rest being aluminium and inevitable impurities; b) homogenizing the cast billet at a temperature 30° C. to 100° C. lower than solidus temperature; c) heating the homogenized billet at a temperature lower than solidus Ts, between Ts and (Ts−45° C.) and superior to solvus temperature; d) cooling until billet temperature reaches a temperature between 400° C. and 480° C. while ensuring billet surface never goes below a temperature substantially close to 350° C.; e) extruding at most a few tens of seconds after the cooling operation the said billet through a die to form at least an extruded product; f) quenching the extruded product down to room temperature; g) stretching the extruded product; h) ageing the extruded product, without beforehand applying on the extruded product any separate post-extrusion solution heat treatment, the ageing treatment being applied such that the product presents an excellent compromise between strength and crashability, with a yield strength Rp0.2 higher than 240 MPa, preferably higher than 280 MPa and when axially compressed, the profile presents a regularly folded surface having cracks with a maximal length of 10 mm, preferably less than 5 mm.

It is generally known, for instance from the publication "Properties for aluminum alloys", Mr. J. Gilbert Kaufmann, ASM International, that many aluminum alloy products are given a small amount of cold work following solution heat treatment and quenching in order to minimize the internal residual stresses resulting from combination of working, holding at high temperatures and quenching rapidly. It is stated here that the amount of cold work given from stress relief treatment generally is in the range of 1 to 3% stretching for plate, rolled or extruded products and 3 to 5% compression for forgings. The amount of stretching for stress relief referred to here is much higher than normally used in a modern extrusion plant. Most likely, this is due to the T6 treatment with separate solutionizing followed by dropping a bundle of long profiles into a deep quench tank. In this case, the profiles will twist and bend much more than if a profile is quenched when it is held by a puller. For a T5 treatment much less stretching is used, normally in the range of 0.3-1.0% plastic deformation.

In the same article, there is a chapter on "Effect of Additional Cold Work Following Solution Heat Treatment", which refers to studies on the effect of stretching on fatigue properties of alloys 2024, 6061 and 7075. None of these alloys shows any benefits of the stretching and for alloy 7075 possibly a negative effect.

In the ASM Specialty Handbook, "Aluminum and Aluminum Alloys", edited by J. R. Davies there is a chapter on thermomechanical effects on ageing. The T3 temper refers to cold working after extrusion whereas the T8 refers to cold working after separate solutionizing. Here it is stated that alloys of the 2xxx series, such as 2014, 2124 and 2219, respond positively to cold working after quenching with respect to strength, whereas other alloys show no or little added strengthening for the same type of treatment. For 2xxx series alloys there are several T3 and T8 type of tempers while 7xxx series alloys, which do not respond positively to cold work following the solution treatment, no such tempers are standard.

Results of extensive experimentation with 7xxx alloys is further carried out and published by ASM (American Society for Metals), "Properties and Physical Metallurgy, John E. Hatch, where among other things is concluded that for 7xxx alloys "the attainable strength decreases progressively with increasing cold work up to at least 5%". This effect is attributed to the dislocations that are causing heterogeneous nucleation of the η'-precipitates and thereby suppressing the more dense homogeneous nucleation of the η"-precipitates that gives a higher strength contribution. Cold working by cold rolling to higher levels than those used for stress relief purposes can provide hardness levels surpassing those provided by precipitation hardening effects only, but those are not used commercially.

Accordingly, it is desirable to have a method that allows efficient production of structural components from heat treatable aluminium alloys that not only produces said components with improved mechanical properties, but also enables an efficient production. Such a method is especially desirable as the alloys that allow improved mechanical properties of a structural component generally also offer more deformation resistance during the production of a structural component, for example during extrusion, and therefore result in an inefficient production process.

Accordingly, the invention provides a method for producing structural components from heat treatable aluminum alloys, in particular AA 6xxx series alloys, the components having improved crush properties and being particular applicable in crash zones of vehicles, such as longitudinals and crash boxes, the method including the following steps.

When producing the component by extrusion, the method according to the invention may include the following steps:

a. casting a billet from said alloy by DC casting,
b. homogenizing the cast billet,
c. optionally heating the billet to a desired temperature before extrusion
d. forming a profile from the billet by extrusion, preferably a hollow section
e. optionally, separate solution heat treatment,
f. quenching the profile down to room temperature after the forming step or the possible separate solutionizing step,
g. stretching the extruded or the separate solutionized profile to obtain at least 1.5% plastic deformation,
h. artificially ageing the profile.

When producing the components from a rolled sheet, the method according to the invention includes the following steps:

a. casting a rolling slab from said alloy by DC casting,
b. homogenizing and/or preheating the rolling slab,
c. hot and cold rolling the slab down to the desired thickness,
d. separate solution heat treatment,
e. quenching the rolled sheet down to room temperature,
f. forming and welding/joining to create a structural member, preferably a hollow shape from the rolled sheet,
g. stretching the rolled sheet prior to forming or the structural member after forming to obtain at least 1.5% plastic deformation,
h. artificially ageing the structural member.

As is apparent from the experimental data provided below, it has been found that the stretching of the structural member or the extruded profile produced according to the method according to the invention to obtain at least 1.5% plastic deformation greatly improves the crushperformance. It has further been found that the production efficiency of the structural member can be further improved when the method comprises a heterogenizing step (herein also referred to as "soft annealing") after the homogenizing step and before the extrusion step. This allows precipitating $Mg_2Si$ from the Al-rich phase (α-phase) resulting in a depletion of Mg and Si from the Al-rich phase. This reduces the deformation resistance of the alloy and allows better extrusion performance. The stretching according to embodiments of the invention is carried out after the solutionizing step and before the aging (also before the optional pre-aging) for embodiments in which a structural member (e.g. a profile) is formed by extrusion. It has been found that when the process comprises heterogenizing, better properties of the profile are obtained if the process comprises solutionizing as well. For rolled material, stretching according to the invention is carried out after the solutionizing step and before forming a structural member (i.e. the rolled sheet metal is stretched) or after forming the structural member (i.e. the sheet metal that has been formed into the structural member is stretched). In other words, the structural member is optionally stretched for embodiments in which a structural member (e.g. a profile) is formed from rolled sheet metal, wherein the stretching is also in these embodiments carried out before the aging (e.g. before the pre-aging).

Homogenization may for example be carried out at a temperature between 520° C. and 590° C., e.g. at a temperature between 550° C. and 580° C., for a duration of more than 0 hour and less than 12 hours, wherein a value of 0 hours indicates that the alloy is heated to reach the homogenizing temperature and, when reaching the homogenizing temperature, is immediately cooled. According to embodiments, the homogenization is carried out for 1 to 4 hours. The temperature and time should be chosen so that the single phase region with respect to Al, Mg and Si in the phase diagram is reached so as to bring these (and further elements) into solid solution in the Al-rich phase. Further, homogenization may be carried out such as to precipitate intermetallic phases of elements that are not fully solvable in the Al-rich alpha phase.

According to embodiments of the invention, homogenization may be followed by a heterogenization step (also referred to as "soft annealing"). Said heterogenization step may immediately follow the homogenization (i.e. without any cooling below the heterogenizing temperature between the steps) or may be carried out separately (i.e., there may be cooling below the heterogenization temperature, e.g. to room temperature, between the steps). When the heterogenization is performed immediately after the homogenization, the process is more efficient and uses less energy. When homogenization and heterogenization are carried out separately, the process is more versatile. The cooling from the homogenization temperature to the heterogenizing temperature or, when homogenization and heterogenization are carried out separately, to room temperature, is, according to embodiments of the invention, performed using a cooling rate of between 25° C./hour and 500° C./hour. According to embodiments the cooling rate between homogenization and heterogenization temperatures is for example between 100° C./hour and 400° C./hour.

The heterogenizing step may for example be carried out at a temperature of between 350° C. and 450° C., for example between 390° C. and 430° C. A 6061 alloy has a solvus temperature of about 540° C., so, according to embodiments of the invention, the heterogenizing temperature may be at least about 90° C. lower than the solvus temperature of the invention. For the heterogenizing, an alloy may be held for 0 to 12 hours, for example for 1 to 12 hours, e.g. for 2 to 8 hours, at the heterogenizing temperature, wherein a value of 0 hours indicates that the alloy is slowly cooled from the homogenizing temperature, e.g. at 25° C./hour or less, all the way down to 350° C. or even below, e.g. to room temperature. After homogenizing or after homogenizing and heterogenizing, the billet is extruded or otherwise processed as described herein.

The stretching may be carried out so that the profile obtains at least 1.5% plastic deformation, e.g. more than 1.5% plastic deformation, for example 2% or more plastic deformation, for example 3% or more plastic deformation, for example 4% or more plastic deformation. Herein, stretching by x % may mean that a length before and after stretching differs by x % in the stretching direction after the stretching forces are relaxed. For example, a length that was 1 m before stretching may correspond to a length of 1.04 m after stretching by 4%.

After the stretching, ageing is carried out. The ageing may for example be performed as a one-step, two-step or a dual rate ageing process. In addition, the ageing may optionally comprise a pre-aging step. In this respect, it has been found that it is beneficial for the strength of 6xxx alloys with high contents of Mg and Si (e.g. 6061 or 6082) when the ageing is done as soon as possible after the solutionizing. There is a beneficial effect when ageing is carried out up to approximately 4 hours after the solutionizing, but the beneficial effect is the stronger the sooner the ageing is done after the solutionizing. However, the present inventors have discovered that a similar beneficial effect can also be achieved if only a short ageing cycle, herein referred to as pre-ageing, is started within 4 hours after solutionizing. After this pre-aging, the material may be held at room temperature, e.g. for up to several weeks, before further ageing is carried out. The use of pre-aging therefore allows to obtain the beneficial effects on strength that are achieved by carrying out ageing shortly after extrusion or solutionizing, while at the same time a more flexible production method is obtained.

As mentioned, the pre-aging step after the stretching that can further improve the mechanical properties of the profile. The pre-aging may for example be carried out at a temperature between 90° C. and 230° C. for a duration between 1 and 120 minutes, for example for between 1 and 7 minutes at a temperature between 140° C. and 160° C. However, depending on the alloy and the profile and the desired properties, also other temperatures and durations are possible.

According to embodiments, the pre-aging is started up to 15 minutes after the extrusion or the optional solutionizing is finished, although according to embodiments pre-aging may be started until up to 4 h after the solutionizing is finished.

After stretching and optionally pre-aging, the profile may be artificially aged to the desired temper designation.

It has been found that the method according to an embodiment of the invention is particularly useful to produce extruded or rolled automotive parts where high strength and thin walls are wanted in order to save weight. This could for example be sills, which typically are extruded multi-chamber profiles. Such an automotive sill may for example be part of the vehicle body section below the base of the door openings of the vehicle body. A wall of a profile forming such an automotive part, e.g. a sill, can be rather thin. As the method according to embodiments of the invention allows the production of profiles with improved mechanical properties and allows, especially if heterogenization is used, to use favorable extrusion process parameters, thin-walled profiles with wall thicknesses smaller than 2.00 mm, e.g. smaller than 1.5 mm, and improved mechanical properties may be efficiently produced without defects.

Figure 2:
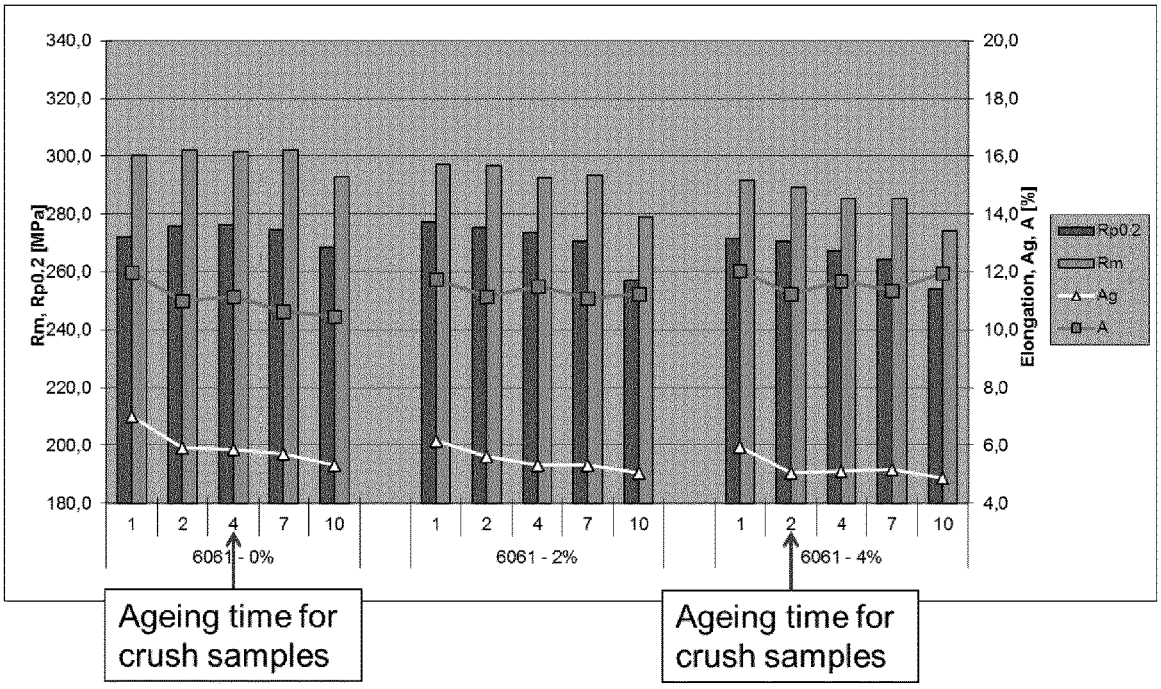
Figure 3:
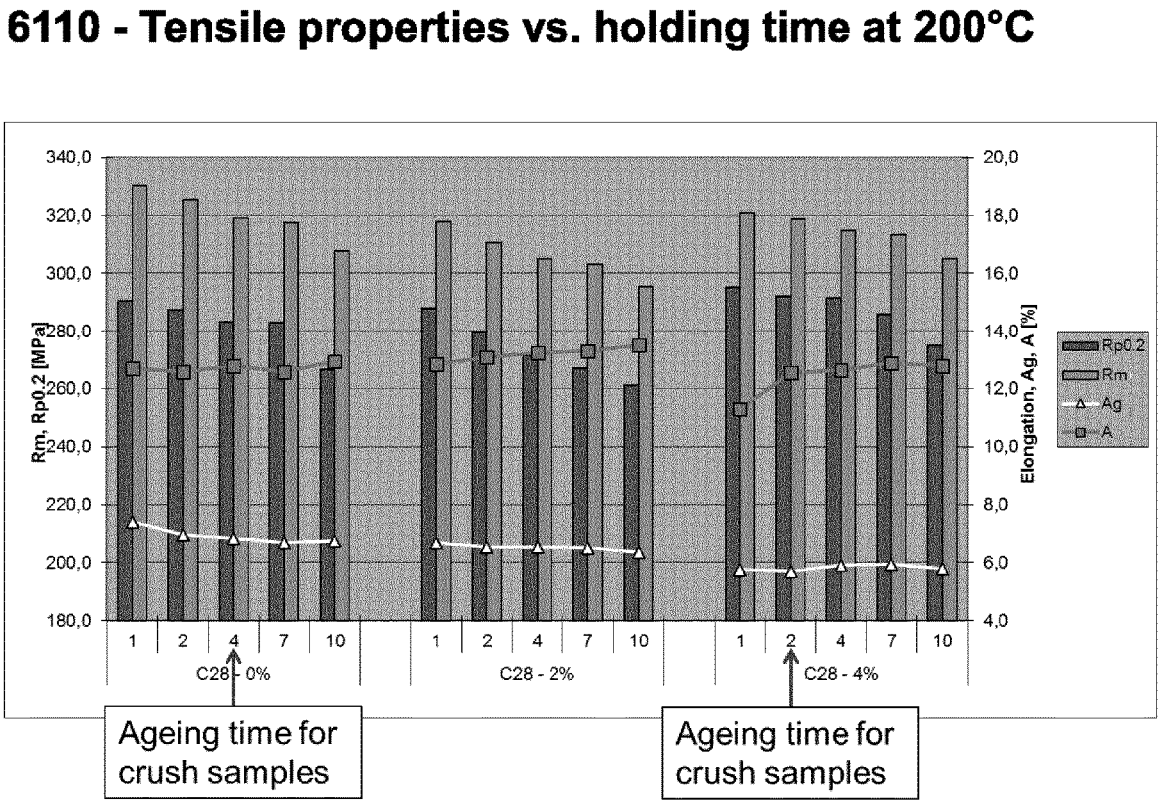
Figure 4:
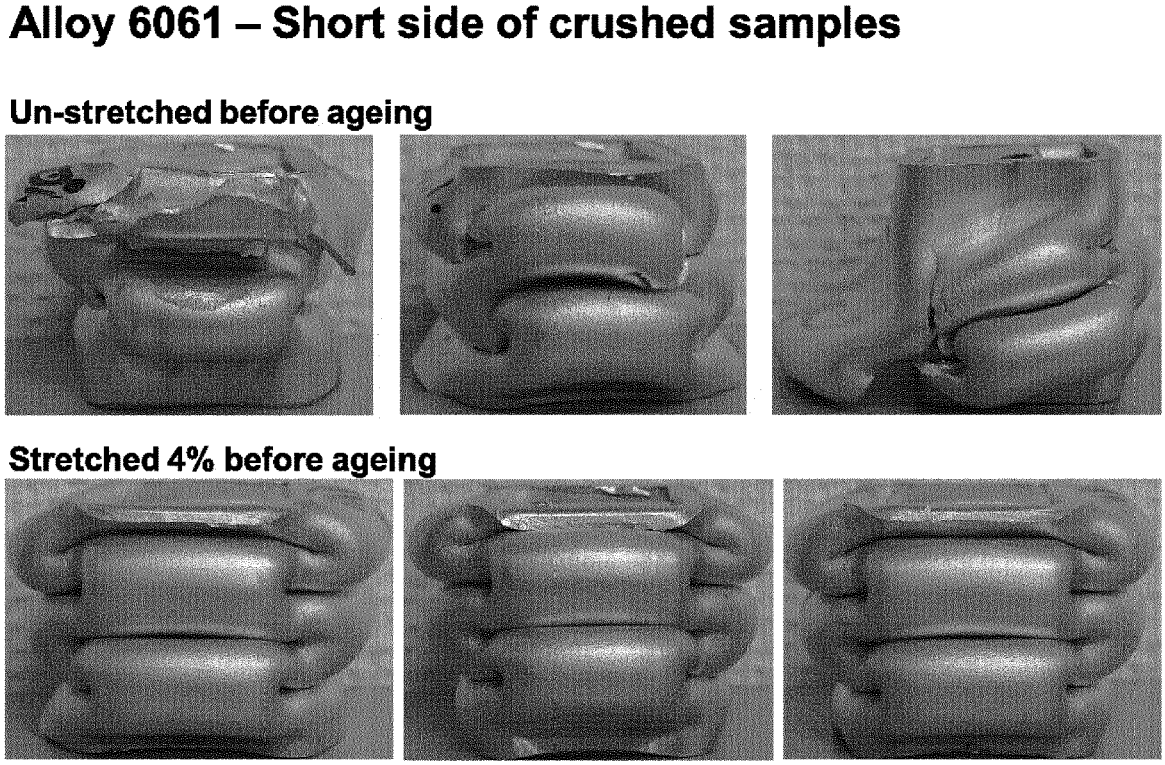
Figure 5:
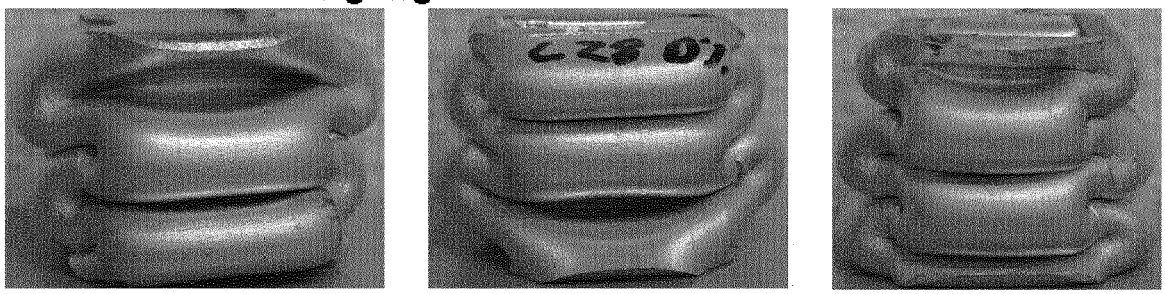
Figure 5:
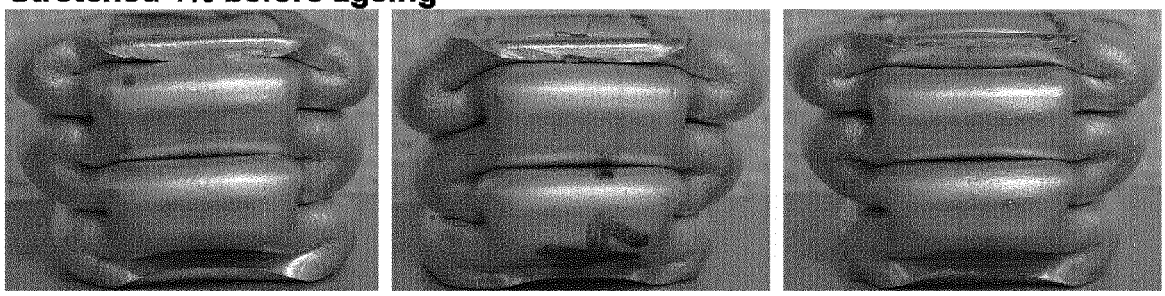
Figure 6:
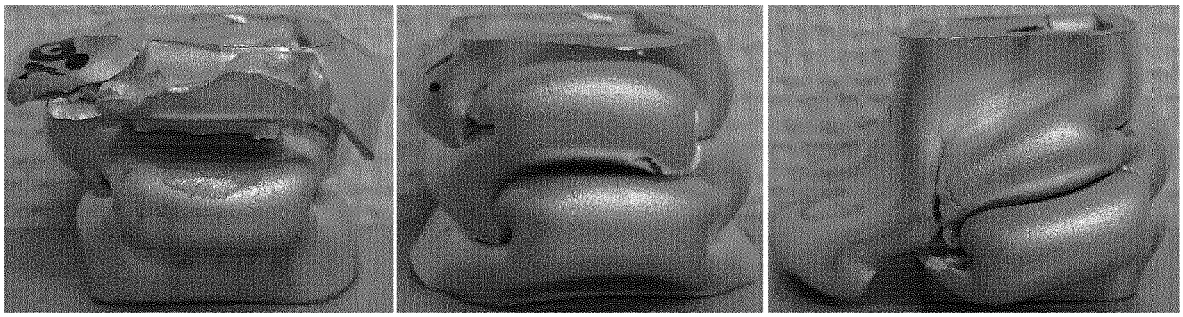
Figure 6:
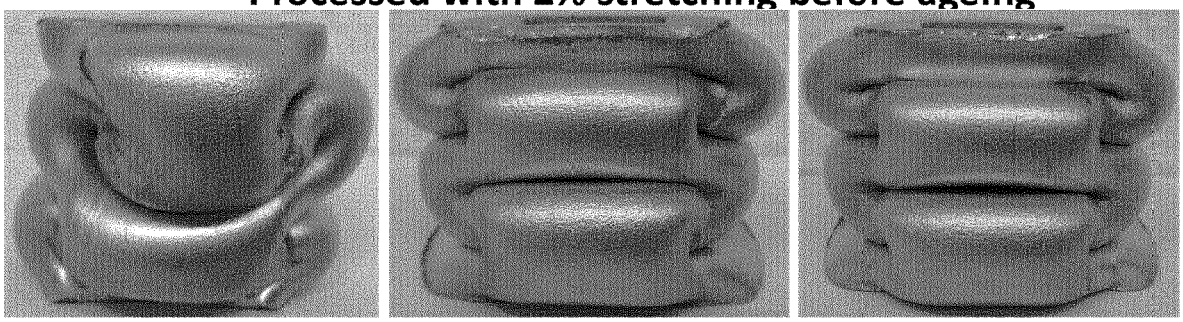
Figure 7A:
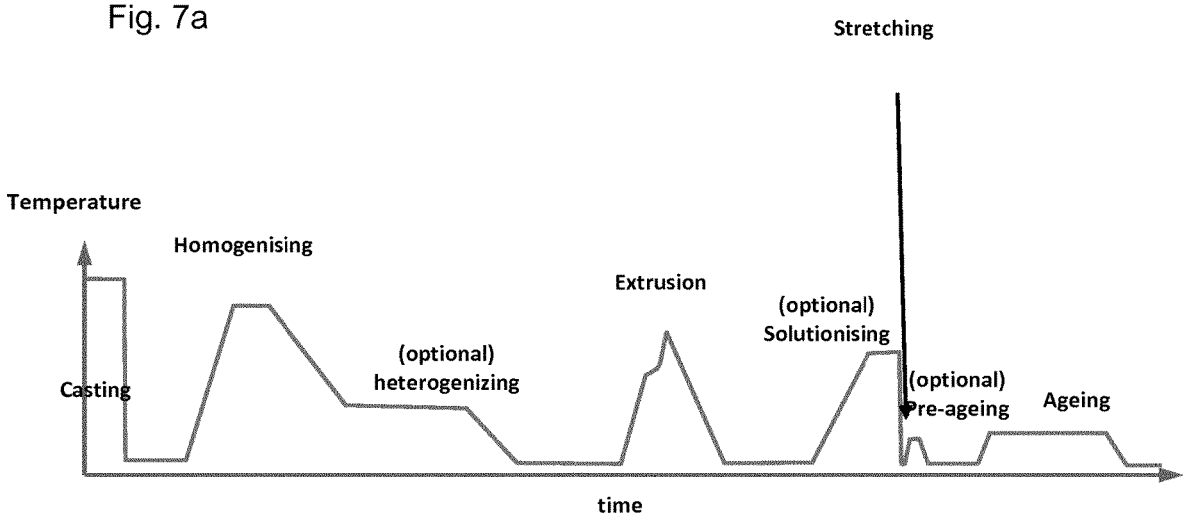
Figure 7B:
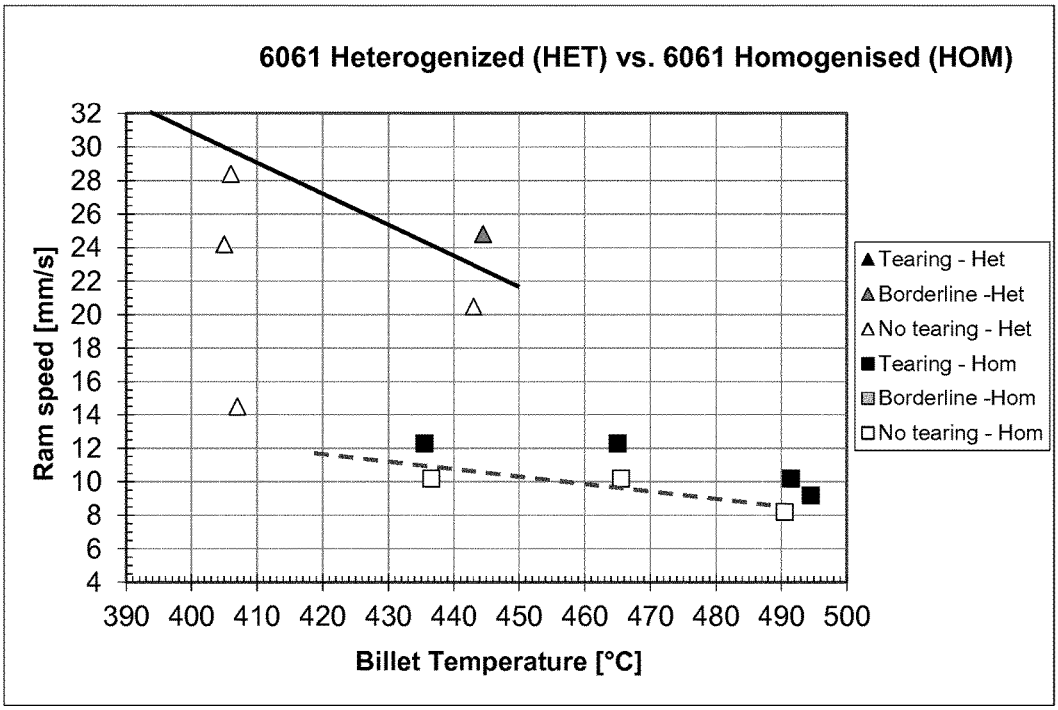
Figures 8A, 8B:
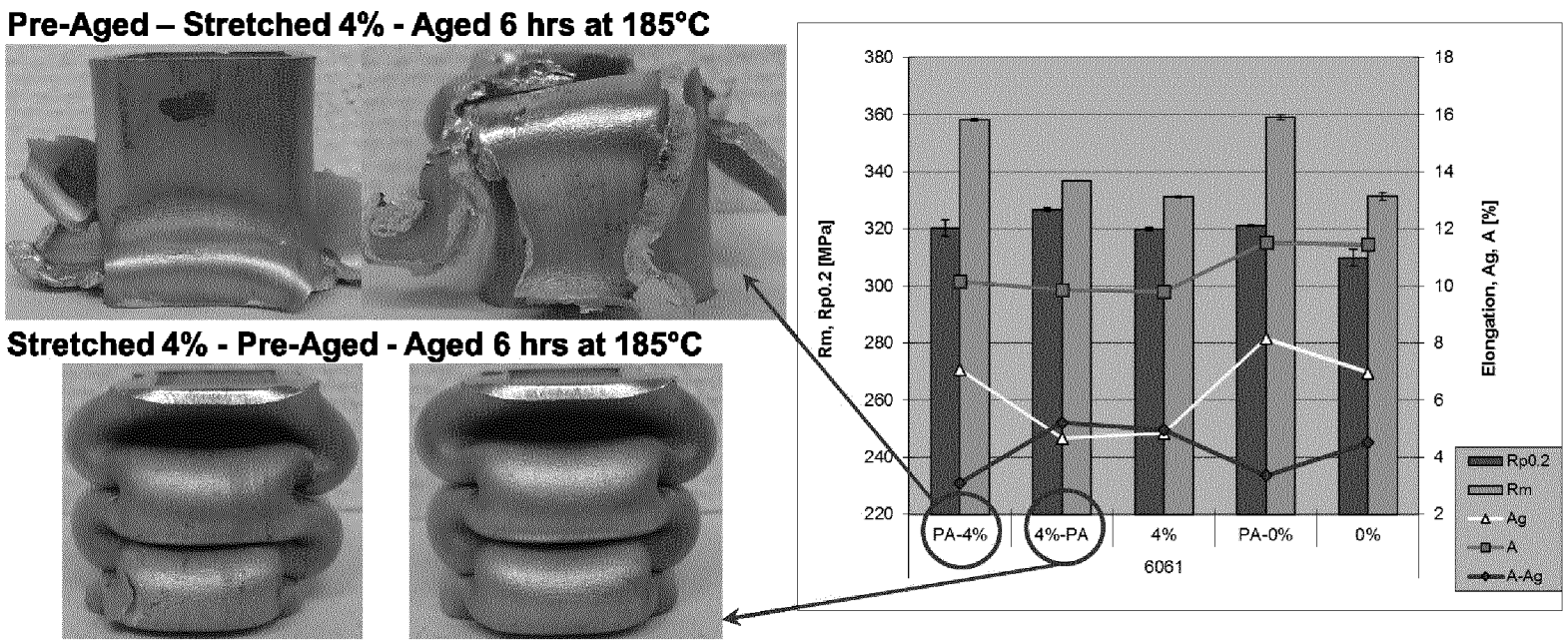
Figure 8C:
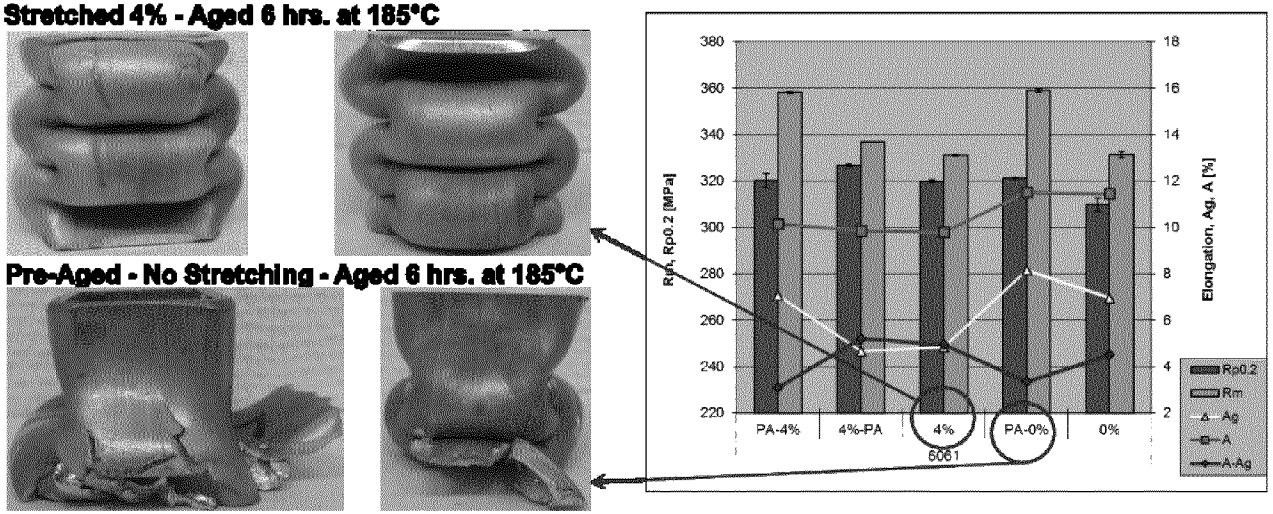
Figure 8D:
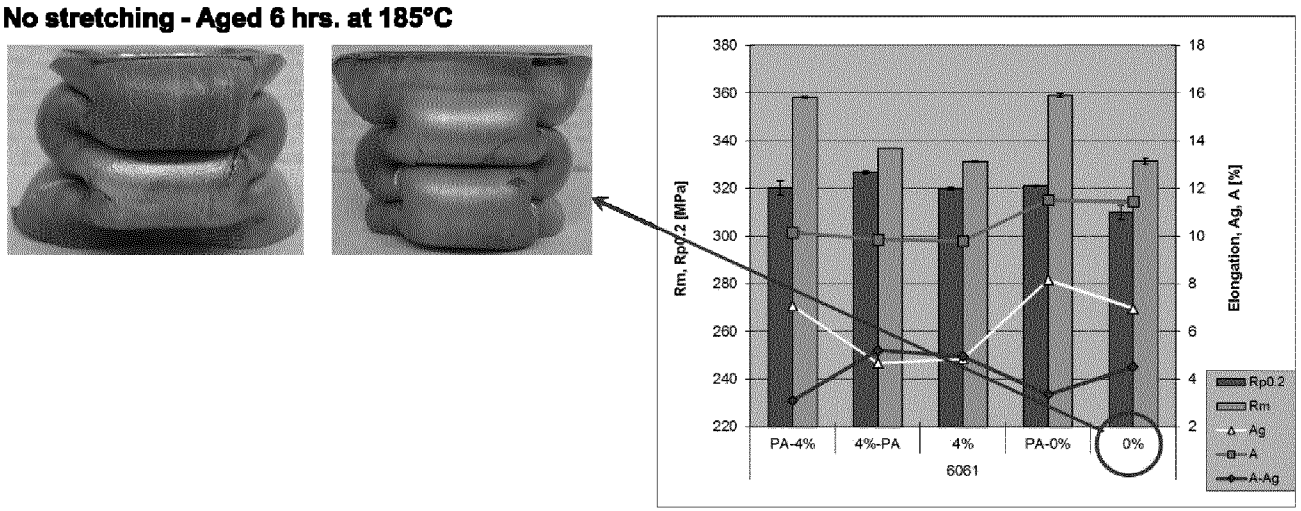
Figure 9:
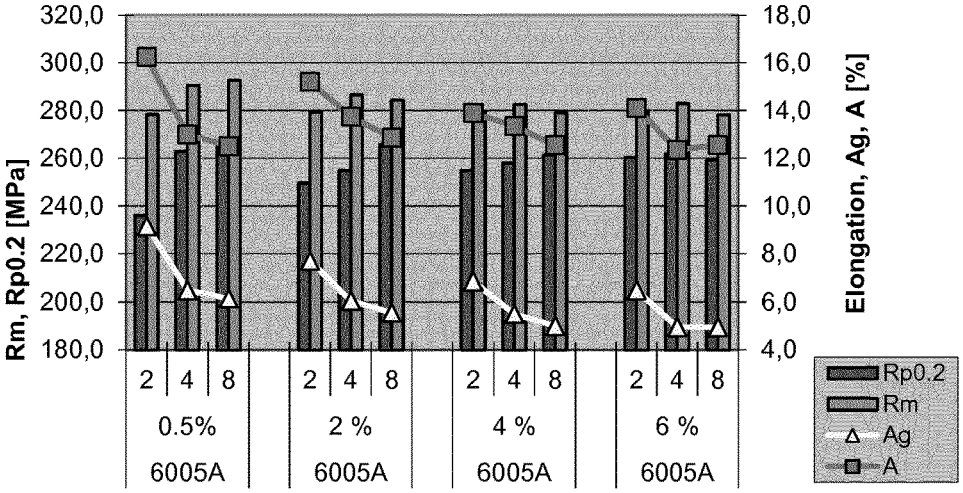
Figure 9:
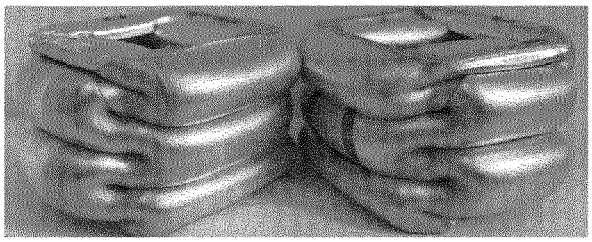
Figure 9:
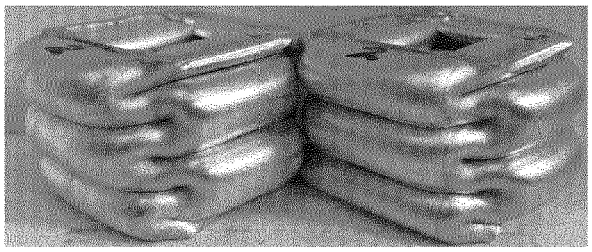
Figure 9:
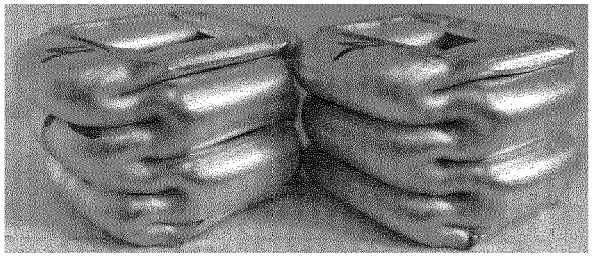
Figure 10:
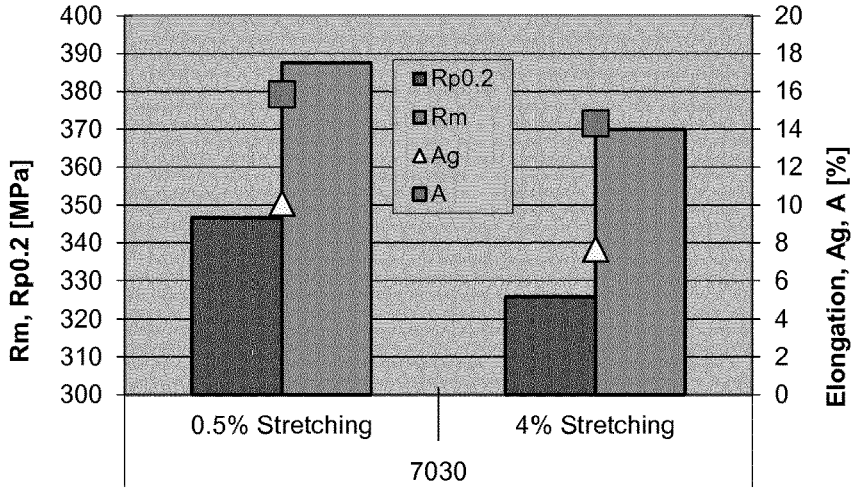
Figure 10:
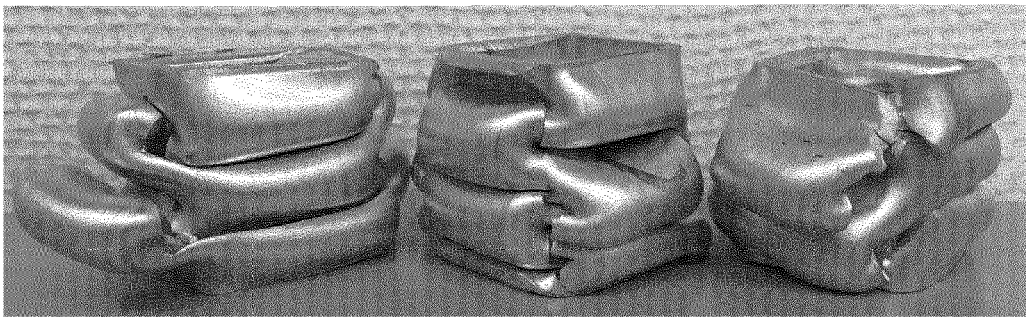
Figure 10:
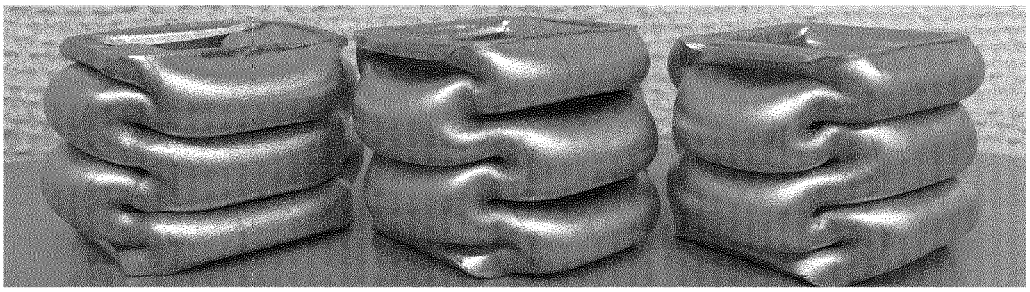
Figure 11A:
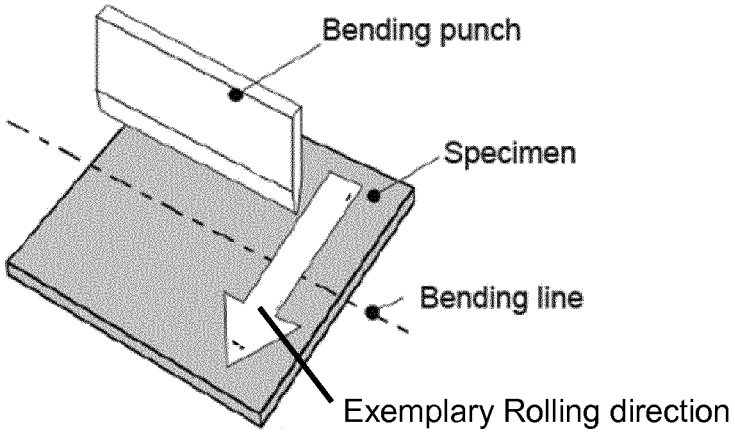
Figure 11A:
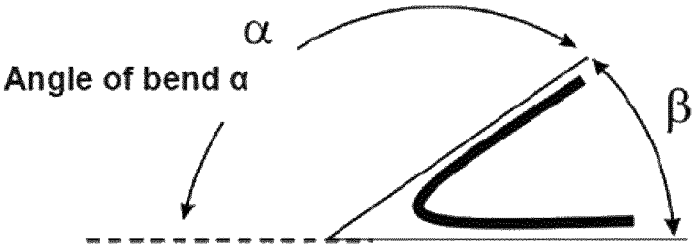
Figure 11A:
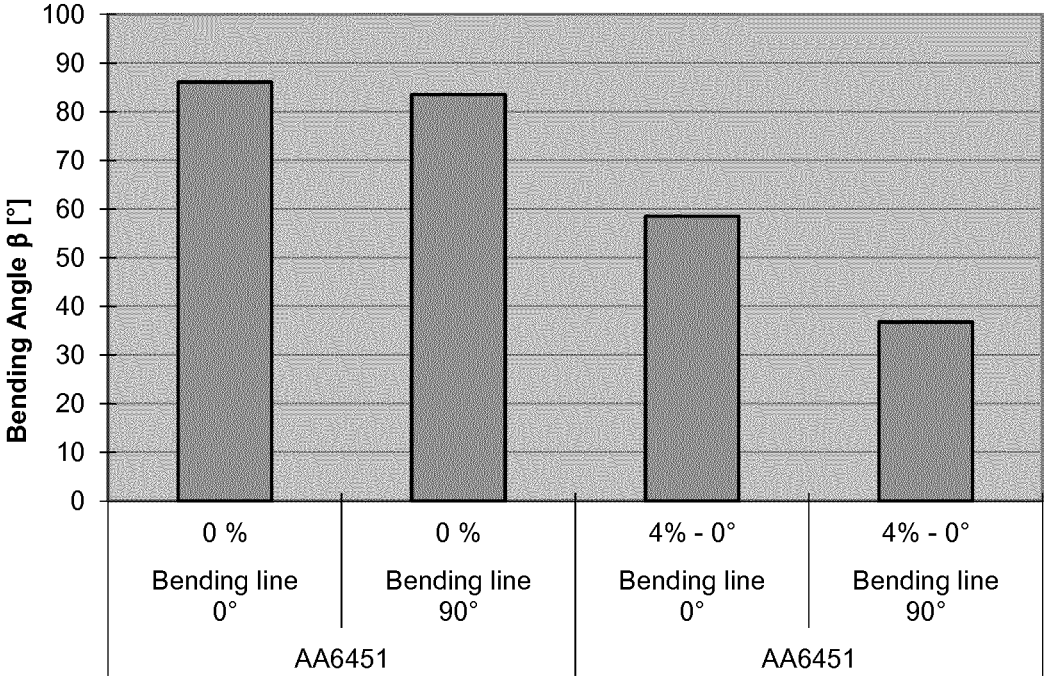
Figure 11B:
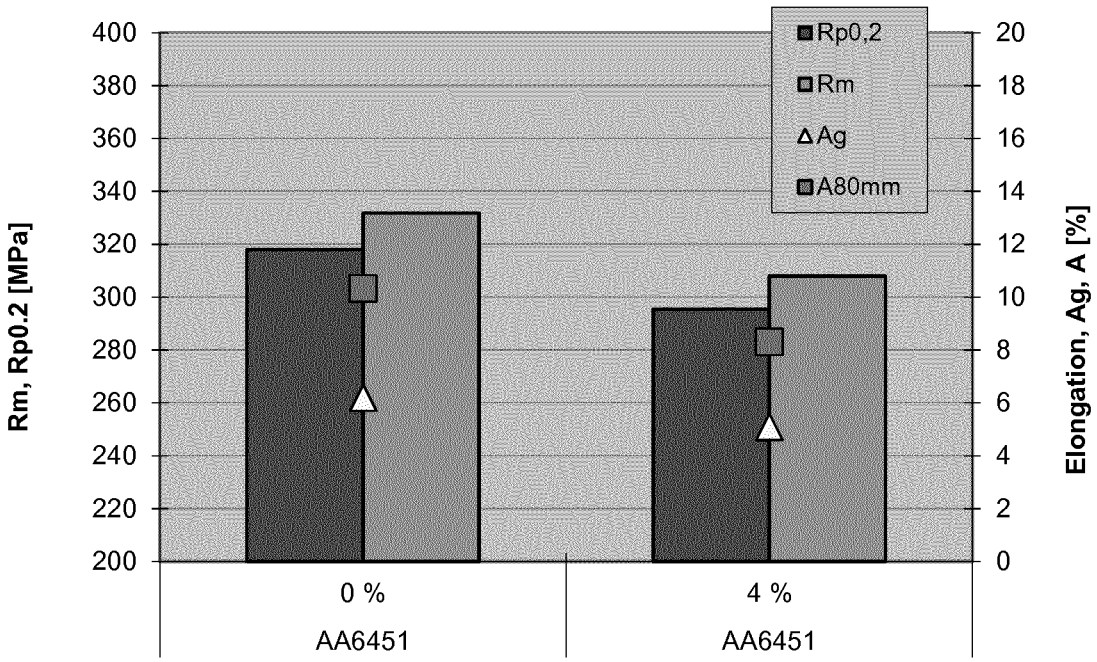
Figure 12:
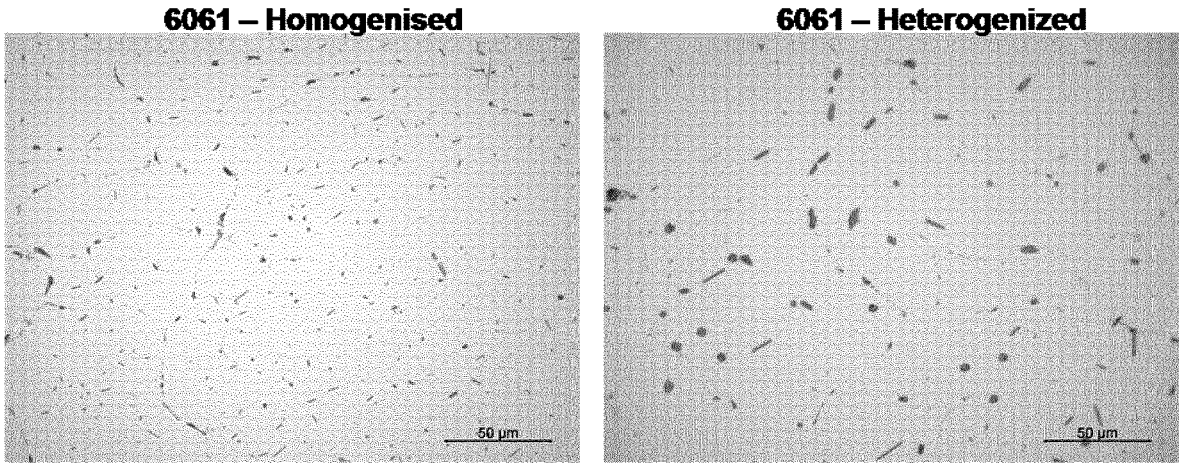
Figure 13:
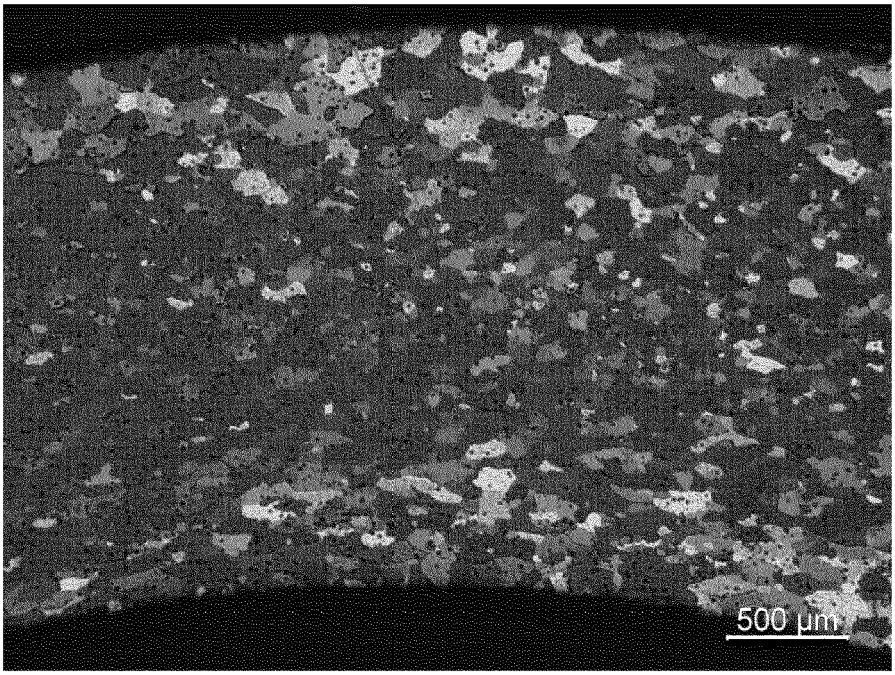
Figure 13:
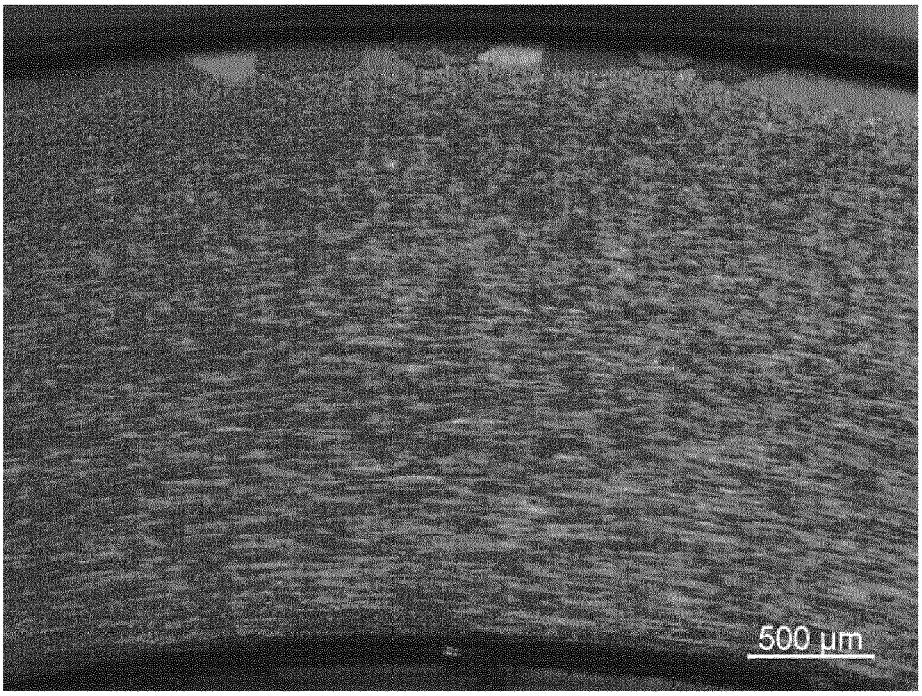

The invention will be further described in the following by way of example and with reference to the drawings, where:

FIG. 1 shows a cross section and photos of an aluminum profile used for crash testing of alloys according to the invention, FIG. 2 shows tensile properties vs. holding time at 200° C. for tested 6061 alloy, FIG. 3 shows tensile properties vs. holding time at 200° C. for tested 6110 alloy, FIG. 4 shows photos of crushed profiles of a 6061 alloy, FIG. 5 shows photos of crushed profiles of a 6110 alloy, FIG. 6 shows photos of crushed profiles of a 6061 alloy, FIG. 7*a* shows a schematic temperature over time profile according to an embodiment of the invention, FIG. 7*b* shows extrusion performance after homogenizing according to the invention and after homogenizing and heterogenizing according to the invention, FIGS. 8*a* to 8*d* show crushed profiles and mechanical properties of 6061 alloys processed according to various methods according to the invention and comparative examples, FIG. 9 shows photos of crushed profiles of a 6005A alloy processed according to embodiments of the invention and comparative examples, FIG. 10 shows photos of crushed profiles and mechanical properties of a 7030 alloy according to the invention and comparative examples, FIG. 11*a* shows results of a bending test performed with sheet material that was processed according to the invention and comparative examples, FIG. 11*b* shows the alloy composition of the sheet material and the strength of unstretched and 4% stretched materials according to an embodiment of the invention, FIG. 12 shows the influence of heterogenizing according to the invention on the microstructure of a 6061 alloy, and FIG. 13 shows the microstructure of a recrystallized and a non-recrystallized extruded profile, respectively.

The choice of materials for a vehicle is the first and most important factor for automotive design and there is a variety of materials that can be used in the automotive body and chassis. The most important criteria that a material should meet are lightweight, economic effectiveness, safety, temperature stability, corrosion resistance, and recyclability in addition to meeting the demands with respect to mechanical strength requirements. With the present invention, the inventors aimed at optimizing the choice of aluminum alloy and method of manufacturing components of the alloy in relation to these criteria.

It was an objective of work in relation to the invention to test how stretching prior to ageing would affect the crush performance of a recrystallized and a non-recrystallized material and thus enable optimal selection of alloy and method of manufacturing.

EXAMPLES

Tests referred to in FIGS. 1 through 6 were performed with two alloys as defined in the table below. All the concentrations are in weight percentage. The balance being aluminium.

| Alloy | Mg | Si | Fe | Mn | Cu | Cr | Ti |
|---|---|---|---|---|---|---|---|
| 6110 | 0.83 | 0.74 | 0.20 | 0.55 | 0.23 | 0.154 | 0.005 |
| 6061 | 0.80 | 0.60 | 0.19 | 0.00 | 0.21 | 0.054 | 0.006 |

The alloys were cast as ø95 mm billets at the applicant's casting lab, using casting parameters that are typical for these kind of alloys. Both alloys were homogenized at 575° C. for 2 hours and 15 minutes, and cooled by approximately 400° C. per hour down to room temperature.

The billets were then extruded to a 29×37 rectangular hollow profile with a wall thickness of 2.8 mm, as shown in FIG. 1. There are four seam welds that are located in the middle of the sidewalls.

The extrusion was performed in a vertical 800-ton extrusion press with a 100 mm diameter container. The preheating temperature prior to extrusion was in the range 500-510° C. for all the extruded billets. The extrusion profile speed was 8.2 m/min for all billets. Immediately after extrusion, the profiles were quenched in water in a tube that was placed approximately 60 cm behind the die opening, and the cooling rate therefore was very high.

The profiles were then cut into approximately 100 cm lengths and stretched to different amounts of plastic strain (0%, 2% and 4%). All profiles, both the profiles that were un-stretched and stretched 2 and 4%, were aged at 200° C. The holding times at temperature were 1, 2, 4, 7 and 10 hours. The tensile results are shown in FIGS. 2 and 3. Based on the tensile results the crush samples from the un-stretched profile were held 4 hours at 200° C. before crush testing. The crush samples from the 4% stretched profile were aged 2 hours at 200° C.

The crush tests were performed mainly in accordance with the car manufacturer Volkswagen, VW TL 116 Norm. The difference was that the samples were only 100 mm to start with and then crushed down to approximately 35 mm. In the current tests, three parallel crush samples were tested at each condition.

Studying the results of the tests, 4% stretching appears to have a dramatic effect on the crush properties for the 6061 alloy used in the current test. This alloy only have 0.05 weight percentage of Cr, which is a too low amount to give a substantial number of dispersoid particles and thereby to prevent recrystallization of the profile after extrusion. This profile therefore has a recrystallized grain structure with high angle grain boundaries. In this respect, FIG. 13 shows a recrystallized grain structure in an extrude profile made of the 6061 alloy and a non-recrystallized grain structure in an extruded profile made of a 6110 alloy. As is shown in FIG. 4, the un-stretched profiles as depicted in the upper photos have severe cracks, while the lower photos show that the stretched profiles have no cracks at all after crushing.

As the current findings confirm that stretching has an effect on the crush properties of the tested 6061 alloy, it is also quite likely that stretching prior to ageing has a similar effect on other 6xxx alloy variants that give a recrystallized structure in the extruded profile.

Alloy 6110 contains 0.55 weight percentage Mn and 0.15 weight percentage Cr and therefore has many dispersoid particles (mainly α-AlFe(MnCr)Si type). Due to the high amount of dispersoid particles, the extruded profile of this alloy will normally have a non-recrystallized grain structure (cf. FIG. 13). As can be seen in FIG. 5, even though this profile do not have high angle boundaries, but rather low angle grain boundaries between the sub-grains in the non-recrystallized grain structure, there is still a notable effect of stretching on the crush properties. The stretched samples are perfect, without any cracks, whereas the un-stretched samples have some cracks in the corners.

As is apparent from FIG. 6 that shows samples of a 6061 alloy that have been crushed to about ⅓ of the original length, also samples that are processed with 2% stretching before aging at 200° C. for 2 hours exhibit a significantly improved crush resistance. From these results, it is deducted that stretching of about 1.5% or more results in improved crush behavior, although even better results are achieved by stretching of about 2% or more, for example 3% or more, for example 4% or more.

FIG. 7*a* shows a temperature over time profile of the method according to an embodiment of the invention. As has been mentioned, while Mg and Si contribute to the improved mechanical properties of aluminium alloys, the elements also result in a reduced extrusion efficiency when a conventional process route is used. It has been found that Mg and Si, when they are in solid solution in the aluminium-rich phase of an alloy, increase the deformation resistance of the alloy and therefore reduce the extrusion performance. However, when the alloy is heterogenized according to the invention before carrying out the extrusion, the extrusion speed may be greatly increased. It is thought that the Al-rich phase of the alloy is depleted in Mg and Si by the precipitation of $Mg_2Si$ precipitates when the heterogenization according to embodiments of the invention is carried out. FIG. 7*b* shows an overview of extrusion experiments that have been conducted with 6061 alloys (designated as "HOM") prepared by only homogenizing and with 6061 alloys (designated as "HET") that were homogenized and heterogenized before extrusion. The chemical composition is given in the insert below the graph, wherein the balance is Al. The homogenized samples were soaked at 550° C. followed by cooling at 400° C. per hour down to room temperature. The heterogenizing according to an embodiment of the invention was performed by cooling the billets from the homogenizing temperature of 550° C. by 25° C. per hour down to 350° C., followed by a holding step at 350° C. for 8 hours, although also shorter or longer holding times are possible according to the invention. As can be seen from the graph, the heterogenizing allows significantly faster ram speeds. Due to the lower deformation resistance in the heterogenized material it is possible to use lower billet temperatures and still have enough available pressure for extruding the billet. In this case both the lower deformation resistance and the lower billet temperature contribute to the increased extrusion speeds. With homogenizing alone the deformation resistance is higher and higher billet temperatures have to be used. In addition, since the extruded profile of a homogenized billet normally is going to be press quenched and not subjected to a separate solutionizing step, the billet temperature needs to be high enough to get all or most of the Mg and Si in solid solution prior to ageing, which is necessary in order to get the required strength. Large $Mg_2Si$ particles that have been form during the heterogenizing step may be dissolved by a subsequent heat treatment step in the form of a solutionizing step according to embodiments of the invention that dissolves said $Mg_2Si$ particles.

FIG. 8 shows the influence of the optional pre-ageing treatment in combination with the stretching on the mechanical properties of the profiles. In this respect, FIG. 8*a* shows an overview of the chemical composition of the extruded samples tested in FIGS. 8*b* to 8*d* together with an overview of the process route that was used for the respective samples. The samples have been solutionized after extrusion. It can be seen from FIGS. 8*b* to 8*d* that the yield strength values Rp0.2 are ranging from 310 Mpa for the un-stretched variant (0%) to around 325 Mpa for the 4% stretched and pre-aged variant (4%-PA). The ultimate tensile strength values Rm for the variants (PA-4% and PA-0%) that have been pre-aged before any further processing are close to 360 Mpa and 20-30 Mpa higher than for the other variants. The 0% stretched variants seem to have the highest total elongation values A. However, this is not critically important for certain automotive parts such as vehicle sills, longitudinals and crash boxes, for which crush resistance is an important property. It is further apparent that the uniform elongation values Ag are highest for the variants (PA-4% and PA-0%) that have been pre-aged before any further processing, whereas the 4% stretched variants (4%-PA and 4%) show the lowest uniform elongation values.

It is apparent from FIG. 8 that there is a strong effect of stretching on the crush properties for the solutionized and water quenched samples. By stretching 4% before any further processing, the ductility appears to be very good. On the other hand, pre-ageing before stretching produces a material that shows a very poor performance in a crush test. The material that was neither stretched nor pre-aged shows a crush performance that is rather poor, but not as bad as the samples that were pre-aged prior to further processing such as stretching.

FIG. 9 shows results according an embodiment of the invention using a 6005A alloy having the composition as given in the insert in FIG. 9 with the balance being aluminium. Billets of the 6005A alloy were heated to around 500° C. and extruded to the same profile as used previously. The aging was carried out as a two-step ageing process. A two-step ageing process is an ageing process in which a first holding temperature is lower than a second holding temperature, wherein there is no cooling between the first and second holding temperatures. It is thought that the first, lower holding temperature results in the creation of many nuclei and that then the growth of the nuclei is facilitated by the second, higher holding temperature. It is thought that such a two-step ageing process yields best gains for lower strength alloys, for examples for alloys other than e.g. 6061 or 6082. Tensile results of the 6005A alloy after such a two-step ageing process with a first ageing step comprising 3 hours exposure at 150° C. followed by a second step with different holding times at 190° C. (2 h, 4 h and 8 h, respectively, of artificially aging) as well as different amounts of stretching before ageing are shown in FIG. 9. The upper picture in FIG. 9 shows samples that were stretched 0.5% prior to ageing (3 h at 150° C. and followed by 4 h at 190° C.). As is apparent, a crack has formed in the upper fold, whereas the other samples that were stretched 2% and 4%, respectively, and aged in the same manner according to the invention show improved mechanical properties and no cracks.

It is thought that when the method according to embodiments is used, the number of dispersoid particles is low when Cr and Mn contents are low, and thus the dispersoid particles do not affect the deformation resistance very much. The material recrystallizes after extrusion and the grain structure in the profile is therefore very stable during the subsequent solutionizing process. The Mg/Si ratio of the alloys according to the invention may be close to $Mg_2Si$ (effective Si and in atomic percent), and the local eutectic melting point around of the particles may therefore be rather high. With excess Si the melting point drops significantly. The "effective" amount of Si is the total amount of Si present in the alloy (as e.g. obtained by chemical analysis) minus the amount of Si bound in primary constituent particles of the type AlFe(MnCr)Si and in possible dispersoid particles of the type Al(MnCr)Si. The melting point significantly affects the extrudability.

As the current findings confirm that stretching has an effect on the crush properties of the tested 6005A alloy, 6110 alloy and 6061 alloy, it is also quite likely that stretching prior to ageing has a similar effect on other 6xxx alloy variants that give a recrystallized or a non-recrystallized structure in the extruded profile.

The fact that recrystallized variants of 6xxx alloys can be used in high strength crush components of vehicles with demands on crush properties, opens up for a significant increase in the productivity at the extrusion plant and thereby reduced production costs for such components.

Even though the 6xxx alloys, based on the above observations related to improved productivity and improved crush properties may be the best choice for structural components in vehicles, some preferred 7xxx alloys as defined in the claims may also represent a good choice for such applications.

In this respect, FIG. 10 shows experiments conducted with a 7030 alloy having the composition shown in FIG. 10 and a balance of aluminium. Homogenized billets of the 7030 alloy shown in the table were heated to around 500° C. and extruded to the same profile as in the other examples. The upper picture indicates that samples that were stretched only to 0.5% prior to ageing show poor crush performance. On the other hand, the lower picture shows samples that were stretched 4% prior to ageing, which exhibit excellent crush performance.

The above tests are performed with extruded hollow profiles. However, the method according to the invention may also be exploited for the production of structural hollow components based on sheet material as well as for the production of solid profiles formed by extrusion or other production means.

In this respect, FIGS. 11*a* and 11*b* show an example in which sheet material of an AA6451 alloy having a composition given in the table in FIG. 11*b* (with balance Al) was subjected to bending tests. The sheet material was cold rolled to a thickness of 1.5 mm prior to solutionizing at 550° C. for 5 minutes at solutionizing temperature. After the solutionizing, the material was water quenched and stored at room temperature. Then, the samples according to the invention were stretched by 4% along the rolling direction (i.e. with an angle of 0° with respect to the rolling direction as is indicated by the designation "4%-0°" in FIG. 11*a*) while the comparative samples were not stretched (0%). The samples were then artificially aged for 6 hours at 185° C. A bending test according to DBL 4919 was then carried out as schematically shown in FIG. 11*a*. The test was stopped and the corresponding bending angle was recorded when the sample started to show the first crack. The results of the bending test are shown in the diagram in FIG. 11*a*. The bending line angle indicates whether the sample was bent parallel to the rolling direction of the cold rolled and solutionized sheet material (bending angle 0°) or whether the sample was bent perpendicular to the rolling direction of the rolled sheet material (bending angle 90°). The bending angle β is indicative of the crush performance, wherein a smaller bending angle indicates a better crush resistance and is therefore more desirable for structural automotive parts. The not-stretched comparative material exhibits a bending angle of about 85° independent of whether the bending line is parallel or perpendicular to the rolling direction. With the samples according to embodiments of the invention that were stretched by 4%, the bending angle is much smaller when the first cracks are observed. In this respect, when the bending line is parallel to the rolling direction, the bending angle is slightly less than 60°. Further, when the bending line is perpendicular to the rolling direction, an even smaller bending angle of 37° is measured. FIG. 11*b* shows tensile properties of the samples as measured in the rolling direction (0°). Even though it is apparent from FIG. 11*b* that the stretched material shows slightly lower strength than the un-stretched material, stretching still seems to have a positive effect on the bending properties. It is thought that a lower ageing temperature and shorter time would probably have reduced the difference in strength.

Accordingly, by combining a process that involves separate solutionizing of the profile after extrusion or rolling with uniform stretching of the profile by more than 1.5% plastic deformation in the axial direction, an efficient method for producing crush resistant parts, such as e.g. automotive sills, longitudinals or crash boxes, is obtained. Said method according to the invention may reduce variations in mechanical properties from the extrusion process. Further, the method may be carried out by less advanced extruders since it is not required to water quench the profiles after extrusion. That the extrusion process may be performed without water quenching may also increase the recovery from the extrusion process (there is less back end scrap produced). The solutionizing according to the invention may also increase the formability, in particular if it is performed directly before the forming operation. It has further been found that the heterogenizing according to the invention can greatly improve extrusion efficiency. In this respect, the heterogenizing may be carried out such that a material having a number density of $Mg_2Si$ particles that have a diameter of more than 3 μm of 1000 per $mm^2$ or more in a cross section is obtained. In this respect, FIG. 12 shows billet cross sections of a 6061 alloy after homogenization and after homogenizing and heterogenizing according to the invention. It is apparent that the number of such large $Mg_2Si$ particles is much higher in the sample that was homogenized and heterogenized than in the sample that was only homogenized, which has a high number of smaller $Mg_2Si$ particles.

The invention claimed is:

1. A method for producing structural components from a heat treatable aluminum alloy based on extruded material, the method including the following steps:

a. casting a billet from the heat treatable aluminum alloy by DC casting, b. homogenizing the cast billet, c. forming a profile from the billet by extrusion, d. optionally, separate solution heat treatment, e. quenching the profile down to room temperature after the forming step and the possible separate solutionizing step, f. stretching the extruded or the separate solutionized profile to obtain at least 1.5% plastic deformation, g. artificially ageing the profile, wherein the alloy is an AA 6xxx alloy that produces a recrystallized grain structure in an extruded section with the following composition:

Si: 0.40-1.3 wt %
Mg: 0.40-1.3 wt %
Cu: max 0.8 wt %
Cr: max 0.15 wt %
Mn: max 0.30 wt %
Fe: max 0.7 wt %
Zn: max 0.8 wt %
Ti: max 0.20 wt %
V: max 0.20 wt %
Zr: max 0.20 wt % and, optionally, other elements each up to 0.05 wt %, in total up to 0.15 wt % and incidental impurities with balance Al.

2. The method according to claim 1, wherein the method comprises the separate solution heat treatment of the extruded profile as well as a heterogenizing step before extrusion following the homogenizing step of the billet, wherein the homogenizing in the homogenizing step is carried out at temperatures between 520° C. and 590° C. for a duration of more than 0 hours and less than 12 hours, and wherein heterogenizing in the heterogenizing step is carried out at temperatures between 350° C. and 450° C. for a duration of more than 0 hour and less than 12 hours.

3. The method according to claim 2, wherein, after the heterogenizing step is carried out, the alloy comprises a number density of $Mg_2Si$ particles having a diameter of 3 μm or more of at least 1000 per square millimeter.

4. The method according to claim 1, wherein the method is a method of producing a vehicle component by extrusion, the vehicle component having at least one wall having a thickness of less than 2 mm.

5. The method according to claim 1, wherein the alloy is within a part of an AA 6061 alloy window that produces a recrystallized grain structure in an extruded section with the following composition:

Si: 0.40-0.8 wt %
Mg: 0.8-1.2 wt %
Cu: 0.15-0.40 wt %
Cr: 0.04-0.15 wt %
Mn: max 0.15 wt %
Fe: max 0.7 wt %
Zn: max 0.25 wt %
Ti: max 0.15 wt % and, and optionally, other elements each up to 0.05 wt %, in total up to 0.15 wt % and incidental impurities with balance Al.

6. The method according to claim 5, wherein the alloy is within the AA 6061 alloy window that produces a recrystallized grain structure in the extruded section with the following composition:

Si: 0.50-0.70 wt %
Mg: 0.80-1.0 wt %
Cu: 0.15-0.35 wt %
Cr: 0.04-0.08 wt %
Mn: max 0.10 wt %
Fe: max 0.35 wt %
Zn: max 0.25 wt %
Ti: max 0.15 wt % and, optionally, other elements each up to 0.05 wt %, in total up to 0.15 wt % and incidental impurities with balance Al.

7. The method according to claim 1, wherein the stretching according to step f) is minimum 2% plastic deformation.

8. The method according to claim 1, wherein the stretching according to step f) is minimum 3% plastic deformation.

9. The method according to claim 1, wherein the stretching according to step f) is maximum 10% plastic deformation.

10. The method according to claim 1, wherein the stretching according to step f) is between 3 and 5% plastic deformation.

11. The method according to claim 1, wherein the amount of stretching of the profile is beyond what is necessary for stress relief and to form the shape of the product.

12. The method according to claim 1, wherein ageing is performed as a one-step, two-step or a dual rate ageing process at temperatures between 100 and 220° C. in a time period of between 1 and 24 hours for a AA 6xxx alloy.

13. The method according to claim 12, wherein the ageing comprises a pre-aging step after the stretching and before the one-step, two-step or the dual rate ageing process, wherein the pre-aging step is started within up to 4 hours after the extrusion or the optional separate solution heat treatment is finished, wherein the pre-aging step is carried out at a temperature between 140° C. and 160° C. for a duration of between 1 minute and 7 minutes, and wherein the profile is held at room temperature between the pre-ageing step and the one-step, two-step or dual rate ageing process.

14. The method according to claim 1, wherein forming the profile from the billet by extrusion is carried out using at least one puller that holds the profile exiting an extrusion press, and wherein the quenching is carried out with a water spray comprising water and air using a quench box that allows to separately control the cooling rates of at least two sides of the profile.

* * * * *